US005323749A

United States Patent [19]

Gras et al.

[11] Patent Number: 5,323,749

[45] Date of Patent: * Jun. 28, 1994

[54] METHOD FOR ELECTRICALLY CONTACTING AN ELECTRICALLY ACTUABLE FUEL INJECTION VALVE

[75] Inventors: Juergen Gras, Bietigheim-Bissingen; Udo Hafner, Ludwigsburg, both of Fed. Rep. of Germany

[73] Assignee: Robert Bosch GmbH, Stuttgart, Fed. Rep. of Germany

[ * ] Notice: The portion of the term of this patent subsequent to Jul. 13, 2010 has been disclaimed.

[21] Appl. No.: 30,967

[22] Filed: Mar. 12, 1993

Related U.S. Application Data

[62] Division of Ser. No. 895,055, Jun. 8, 1992, Pat. No. 5,226,391.

[30] Foreign Application Priority Data

Jun. 6, 1991 [DE] Fed. Rep. of Germany ..... 4118512

[51] Int. Cl.[5] ..... F02M 61/14; H01R 9/09

[52] U.S. Cl. ..... 123/470; 123/472

[58] Field of Search ..... 123/456, 468, 469, 470; 439/130

[56] References Cited

U.S. PATENT DOCUMENTS

| | | | |
|---|---|---|---|
| 4,950,171 | 8/1990 | Muzslay | 123/470 |
| 5,016,594 | 5/1991 | Hafner et al. | 123/470 |
| 5,030,116 | 7/1991 | Sakai et al. | 123/470 |
| 5,121,731 | 6/1992 | Jones | 123/470 |
| 5,131,857 | 7/1992 | Gmelin et al. | 123/456 |
| 5,154,622 | 10/1992 | Ehrentraut et al. | 123/470 |
| 5,203,304 | 4/1993 | Hafner et al. | 123/470 |
| 5,209,204 | 5/1993 | Bodenhausen et al. | 123/470 |

FOREIGN PATENT DOCUMENTS

| | | |
|---|---|---|
| 3907764 | 9/1990 | Fed. Rep. of Germany . |
| 2339948 | 8/1977 | France . |
| 59-43958 | 3/1984 | Japan . |
| 325598 | 11/1957 | Switzerland . |

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

A known fuel injection valve that can be secured to a fuel distributor by rotating the fuel injection valve about a longitudinal valve axis. A first electrical contact element extends out of the valve housing, parallel to the longitudinal valve axis. Such fuel injection valves can be electrically contacted by a bank of contacts that can be mounted on the fuel distributor in a direction of the longitudinal valve axis. The novel fuel injection valve includes first electrical contact elements which extend radially outward. By rotating the fuel injection valve about its longitudinal valve axis, an electrically conductive connection can be made between first electrical contact elements and second electrical contact elements that electrically contact the connection in the fuel injection valve. In this way, a simple, very compact, safe and secure electrical contacting of the fuel injection valves is attained. The electrically actuatable fuel injection valve according to the invention is especially suitable for fuel injection systems of mixture-compressing internal combustion engines with externally supplied ignition.

2 Claims, 3 Drawing Sheets

METHOD FOR ELECTRICALLY CONTACTING AN ELECTRICALLY ACTUABLE FUEL INJECTION VALVE

This is a divisional of copending application Ser. No. 07/895,055 filed on Jun. 8, 1992, now U.S. Pat. No. 5,226,391.

BACKGROUND OF THE INVENTION

The invention is based on electrically actuatable fuel injection valve. From German Patent Disclosure Document DE 39 07 764 A1, U.S. patent application Ser. No. 463,572, filed Jan. 11, 1990 U.S. Pat. No. 5,016,594, an electrically actuatable fuel injection valve is already known to applicant that can be secured to a fuel distributor by means of a bayonet mount, by rotating it about its longitudinal valve axis. The first electrical contact elements of the fuel injection valves, which protrude from the valve housing parallel to the longitudinal valve axis, are electrically contacted by second electrical contact elements, which are disposed on a contact bank that can be mounted on the fuel distributor in the direction of the longitudinal valve axis.

Contacting the known fuel injection valves electrically requires a great amount of space for installation, and in particular a great height for installation in the direction of the longitudinal valve axes, because the process of joining the contact bank having the second electrical contact elements is effected in the direction of the first electrical contact elements of the fuel injection valve and hence in the direction of the longitudinal valve axes.

OBJECT AND SUMMARY OF THE INVENTION

The method for electrically contacting an electrically actuatable fuel injection valve has an advantage of being simple, very compact and safe and has a secure electrical contact. In this way, the space available in the engine compartment of a motor vehicle, for instance, can be used for an optimized intake tube system. The fuel injection valves of the invention can be mounted very simply and electrically contacted in the same operation, so that the installation costs are reduced.

For particularly simple, safe and secure electrical contacting of the at least one first electrical contact element of the fuel injection valve, it is advantageous if the first electrical contact element extends in the radial direction at right angles to the longitudinal valve axis.

To assure a safe, secure and reliable fastening of the fuel injection valve to a valve holder device, it is advantageous if at least two bayonet catches are provided on the valve housing, which serve to form a bayonet mount.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
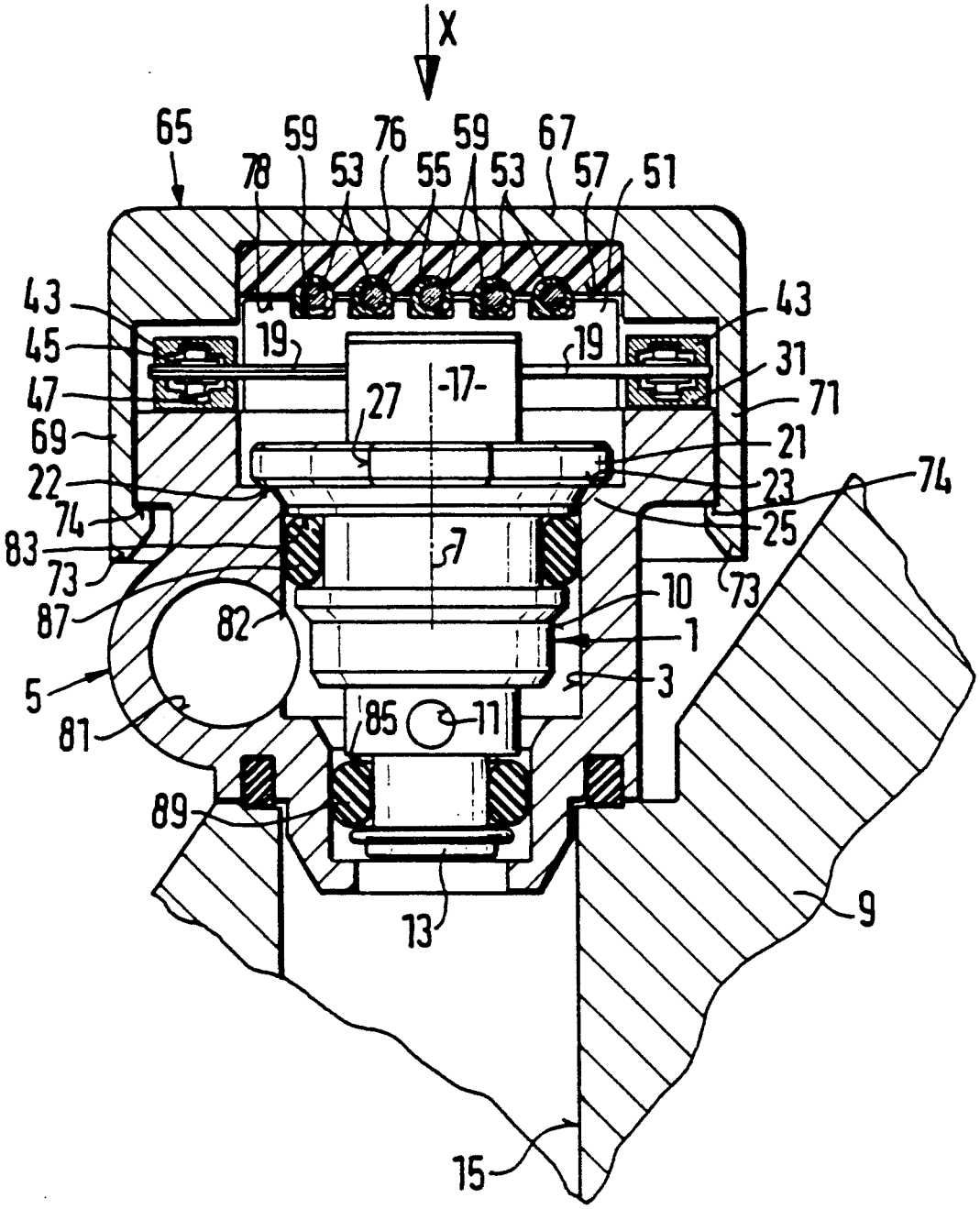
FIG. 1 shows a fuel injection valve according to the first exemplary embodiment of the invention.
Figure 2:
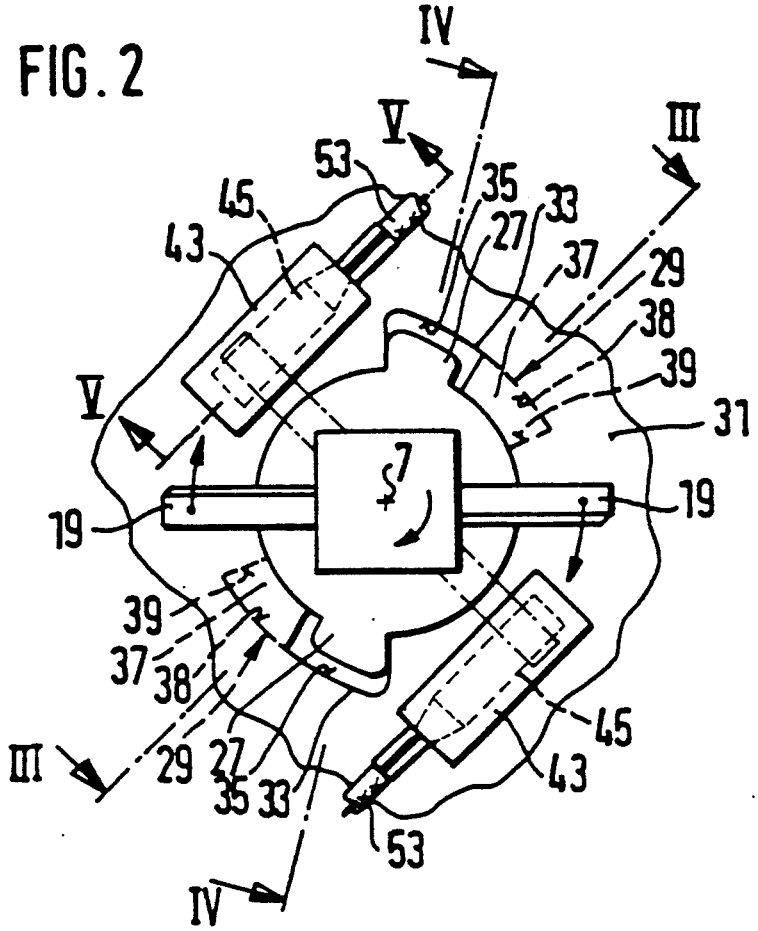
FIG. 2 is a top view of the fuel injection valve in the direction of the arrow X in FIG. 1.

In FIGS. 1–4, a fuel injection valve 1 is shown by way of example, which according to the invention is electrically, for instance electromagnetically actuatable, for fuel injection systems of mixture-compressing internal combustion engines with externally supplied ignition, for example. The fuel injection valve 1 is thrust into a continuous, stepped valve holder opening 3, for instance of circular cross section, of a fuel distributor 5 serving as a valve holder device, and it is at least partly encompassed by the wall of the valve holder opening 3, in the direction of the longitudinal valve axis 7. By way of example, the fuel distributor 1 has an elongated shape extending at right angles to the plane of the drawing and has a plurality of valve holder openings 3. It serves to supply fuel to a plurality of fuel injection valves 1 and is for instance disposed on an intake tube 9 of an internal combustion engine.

On the circumference of its valve housing 10, the fuel injection valve 1 has two fuel supply openings 11, for instance, through which fuel can reach the interior of the fuel injection valve and which are disposed at least approximately at the same axial height along the longitudinal valve axis 7. For injecting the fuel, an injection element 13 on one end of the fuel injection valve 1 is provided, which injects the fuel into an intake tube opening 15 of the intake tube 9. Remote from the injection element 13, the fuel injection valve 1 has first electrical contact elements 19, for instance two in number, on its other end acting as the connection end 17; these contact elements extend radially outward past the circumference of the connection end 17 at right angles to the longitudinal valve axis 7 and serve to electrically contact the electrically actuatable fuel injection valve 1; these first electrical contact elements face in opposite directions from one another, for example, and extend parallel to one another. The first electrical contact elements 19 may take the form of strip-like plug tongues.

A longitudinally extending fuel supply conduit 81 is embodied in the fuel distributor 5, serving to supply fuel to the fuel injection valves 1 and communicating at a respective opening cross section 82, for instance at a tangent, with the valve holder openings 3. Upstream of the fuel supply openings 11 and of the opening cross section 82, an upper annular groove 83 is formed on the circumference of the fuel injection valve 1, toward the connection end 17, and a lower annular groove 85 is formed in the region of the injection element 13 downstream of the fuel supply openings 11 and opening cross section 82. An upper sealing ring 87 is disposed in the upper annular groove 83, and a lower sealing ring 89 is disposed in the lower annular groove 85; they serve to seal off the area between the circumference of the fuel injection valve 1 and the wall of the valve holder opening 3.

Adjoining the connection end 17 of the fuel injection valve 1 in the direction toward the injection element 13, by way of example, a radially outwardly extending retaining flange 21 is formed on the valve housing 10. The fuel injection valve 1 rests with a contact face 22, toward the injection element 13, of the retaining flange 21 on a support face 23, toward the retaining flange, of a retaining shoulder 25 of the stepped valve holder opening 3.

Two bayonet catches 27 extending radially outward past the circumference of the retaining flange 21 are provided, for instance parallel to the first electrical contact elements 19, on the circumference of the retaining flange 21; they face one another and extend circumferentially over only a portion of the retaining flange 21. The two electrical contact elements 19 and the two bayonet catches 27 are for instance offset from one another by 90° each in the circumferential direction.

The bayonet catches 27 serve to secure the fuel injection valve 1 to the fuel distributor 5 by means of a bayonet mount 29; the fuel injection valve 1 is thrust into the valve holder opening 3 of the fuel distributor 5 and secured by being rotated about its longitudinal valve axis 7. Remote from the injection element 13 of the fuel injection valve 1, a bayonet latch 33 surrounding the valve holder opening is embodied on an upper face end 31 of the fuel distributor 5, axially adjacent to the fuel distributor 5 between the upper face end 31 and the retaining shoulder 25. The bayonet latch 33 has two opposed recesses 35 extending partway around the circumference and provided in the wall of the valve holder opening 3, for inserting the bayonet catches 27 of the fuel injection valve 1 in the direction of the longitudinal valve axis 7, these recesses extending from the upper face end 31 as far as the retaining shoulder 25. In the circumferential direction, in the direction of rotation of the fuel injection valve upon installation, the recesses 35 are adjoined by overlapping segments 37, which with a respective groove 38 extending circumferentially and embodied in the wall of the valve holder opening 3 fit around and overlap the bayonet catches 27. Stops 39 for the bayonet catches 27 are provided on the ends of the overlapping segments 37. The stops 39 fix the rotary position of the fuel injection valve 1 in the valve holder opening 3 of the fuel distributor 5 and thus fix the injection geometry of the fuel injection valve 1. For example, the length of the bayonet catches 27 in the circumferential direction of the fuel injection valve is dimensioned such that upon contact of the bayonet catches 27 with the stops 39, the bayonet catches 27 are fully covered by the overlapping segments 37 and toward the recesses 35 are flush with the overlapping segments 37.

A number of electrical connection plugs 43 corresponding to the number of first electrical contact elements 19 of the fuel injection valve 1 to be contacted, or in other words two such connection plugs 43 for example, which are for instance made of plastic, are provided on the upper face end 31 of the fuel distributor 5, near the circumference of the valve holder opening 3, each having a second electrical contact element 45. The connection plugs 43 have plug openings 47, for instance in the form of slits, extending at right angles to the longitudinal valve axis 7 and open in the circumferential direction in the direction of rotation upon installation; the first electrical contact elements 19, which have an elongated shape, can be introduced partway through these plug openings into the connection plugs 43 by the rotation of the fuel injection valve 1 about its longitudinal axis 7. In this way, an electrically conductive connection is established between the second electrical contact elements 45 of the connection plugs 43 and the first electrical contact elements 19 of the fuel injection valves 1, so that the electrical contacting of the fuel injection valves 1 is thereby established.

Figure 5:
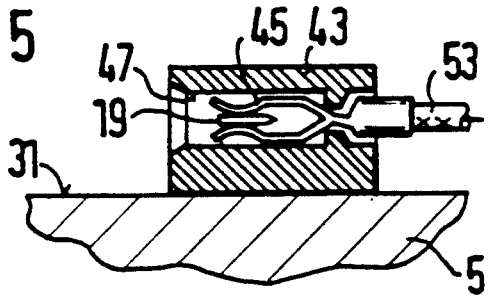
FIG. 5 is a section taken along the line V—V of FIG. 2 through an electrical connection plug serving to electrically contact the fuel injection valve.
Figure 3:
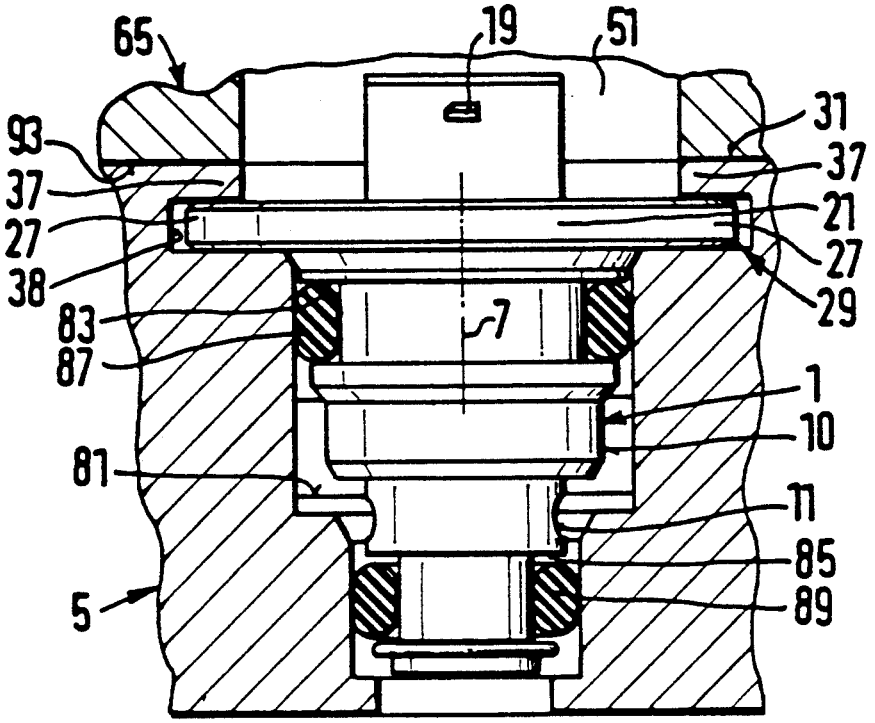
FIG. 3 is a section taken along the line III—III of FIG. 2 in the locked state of the fuel injection valve.
Figure 4:
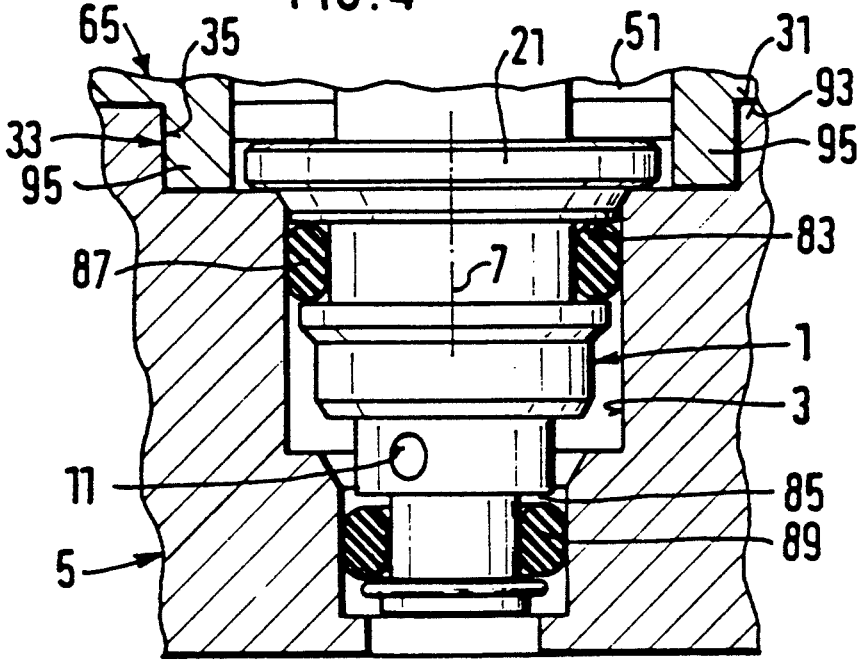
FIG. 4 is a partial sectional view taken along the line IV—IV of FIG. 2 in the locked state of the fuel injection valve.

The connection plugs 43 shown by way of example in FIG. 5 may be part of the fuel distributor 5, for instance being coextruded on the upper face end 31 of the fuel distributor 5, or may be embodied as an independent component, in which case they are joined to the fuel distributor 5 by means of a detent connection, a clamp connection, or an adhesive connection, by way of example.

Between each two adjacent valve holder openings 3, a support element 51 is for instance provided on the upper face end 31 of the fuel distributor 5; the support element serves to fix the position of electrical conductors 53. The electrical conductors 53 are electrically conductively connected to the second electrical contact elements 45 of the connection plugs 43 and serve the purpose of electrically contacting the fuel injection valves 1. As in the exemplary embodiment shown, the electrical conductors 53 may be provided with an electrically insulating sheath 55 surrounding them. The support elements 51 are for instance part of the fuel distributor 5, or in other words are for instance coextruded with the fuel distributor 5, and on their holder side 57 remote from the upper face end 31 of the fuel distributor. 5 they have a number of longitudinal grooves 59, for instance corresponding to the number of electrical conductors 53, and extending longitudinally of the fuel distributor 5. The electrical conductors 53 are disposed in the longitudinal grooves 59 and for instance protrude partway out of the longitudinal grooves 59 past the holder side 57 toward the longitudinal valve axes 7.

On its upper end having the electrical connection plugs 53, the fuel distributor 5 is covered by a covering hood 65, which extends longitudinally of the fuel distributor 5. The covering hood 65, which for instance has a tub-shaped cross section, has a middle cap part 67, which extends at right angles to the longitudinal valve axis 7. The cap part 67 is laterally adjoined by a first leg 69 and a second leg 71, which extend at right angles to the cap part 67 and parallel to the longitudinal valve axis 7. The covering hood 65 covers the part of the fuel injection valve 1 protruding out of the valve holder opening 3 and having its first electrical contact elements 19, the support parts 51, and the electrical connection plugs 43, and the covering hood closes off the valve holder opening 3. The legs 69, 71 fit part way around the fuel distributor 5 on its sides toward the legs, and on their ends remote from the cap part 67 the legs have detent protrusions 73. The detent protrusions 73 fit around radially outwardly pointing retaining shoulder 74 of the fuel distributor 5 and thus enable a connection, which can be simply established and is reliable, between the covering hood 65 and the fuel distributor 5.

A holding-down element 76, which is for instance of a soft rubber or an especially soft, elastic plastic, is disposed between the cap part 67 of the covering hood 65 and the holder side 57 of the support part 51 having the longitudinal grooves 59, in the direction of the longitudinal valve axes. The holding-down element 76 has a length in the direction of the longitudinal valve axes 7 that is great enough that with its face end 78 toward the support part 51, it holds down the electrical conductors 53 disposed in the longitudinal grooves 59 of the support part 51, and thus simply yet effectively prevents the electric conductors 53 from slipping out of the longitudinal grooves 59, for instance from vibration arising during engine operation.

However, it is also possible for the support part 51 to be embodied as a separate component and secured on the covering hood 65 after the installation of the electric conductors 53 in the longitudinal grooves 59, so that a pre-assembled component comprising the covering hood 65, the electric conductors 53, the holding-down element 76 and the support part 51 is formed, which can be mounted on the fuel distributor 5 after the installation of the fuel injection valves 1 in the valve holder openings 3.

For installing and securing a fuel injection valve 1 to the fuel distributor 5 and for electrically contacting the fuel injection valve, the fuel injection valve 1, with its bayonet catches 27, is introduced into valve holder opening 3 of the distributor 5 until the bayonet catches 27 rest on the retaining shoulder 25 of the fuel distributor. After that, the fuel injection valve 1 is turned in a given rotary direction, for instance clockwise, about its longitudinal valve axis 7 until the bayonet catches 27 of the fuel injection valve 1 rest on the stops 39 of the bayonet latch 33. As a result of the rotary motion, the fuel injection valve 1 is simultaneously electrically contacted, in the first electrical contact elements 19, extending radially outward at right angles to the longitudinal valve axis 7, are introduced into the electric connection plugs 43 disposed on the fuel distributor 5 and are electrically joined to the second electrical contact elements 45 of the connection plugs 43.

Two locking prongs 95 per bayonet mount 29, for instance, are formed on a contact face 93 of the covering hood 65 resting partly on the upper face end 31 of the fuel distributor 5; these locking prongs protrude past the contact face 93 in the direction of the longitudinal valve axis 7. In the mounted state of the covering hood 65 on the fuel distributor 5, the locking prongs 95 form-fittingly engage the recesses 35 of the bayonet latch 33. In this way, the locking prongs 95 prevent the bayonet catches 27 and hence the fuel injection valve 1 from turning backward counter to the rotary direction of installation, and thus fix the fuel injection valve 1, inserted into the valve holder opening 3, in both the axial and the rotary directions.

The fuel injection valve 1 according to the invention, having the first electrical contact elements 19 protruding radially past the circumference of the valve housing 10, makes simple, very compact, and safe and secure electrical contacting possible.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A method for electrically contacting a fuel injection valve, which comprises forming a valve housing (10) with a longitudinal axis (7), forming at least one first electrical contact element (79) on said housing (10) of said fuel injection valve (1) radially of said longitudinal axis (7) serving the purpose of electrically contacting said fuel injection valve, forming a cover means for said housing (10), forming at least one second electrical contact element (45) on said cover means radially of said fuel injection valve, rotating the fuel injection valve (1) and the at least one first electrical contact element (79) about the longitudinal valve axis (7) to secure said at least one first electrical contact element (79) to said at least one second electrical contact element (45) to establish an electrically conductive contact between the at least one first electrical contact element (19) of the fuel injection valve (1) and the at least one second electrical contact element (45) and simultaneously securing said fuel injection valve to said cover means (5).

2. A method as defined by claim 1, in which the fuel injection valve is secured to said cover means (5) by means of a bayonet mount (29).

* * * * *